US005845773A

United States Patent [19]

Kim

[11] Patent Number: 5,845,773

[45] **Date of Patent: *Dec. 8, 1998**

[54] GOLF BAG DIVIDER CONSTRUCTION

[76] Inventor: Jin C. Kim, 8161 8th St. No. 6, Buena Park, Calif. 90621

[ * ] Notice: The term of this patent shall not extend beyond the expiration date of Pat. No. 5,573,112.

[21] Appl. No.: 838,740

[22] Filed: Apr. 11, 1997

Related U.S. Application Data

[60] Continuation-in-part of Ser. No. 740,193, Oct. 24, 1996, Pat. No. 5,785,173, which is a division of Ser. No. 561,896, Nov. 22, 1995, Pat. No. 5,573,112.

[51] Int. Cl.[6] ..... A63B 55/00

[52] U.S. Cl. ..... 206/315.6; 206/315.3

[58] Field of Search ..... 206/315.3, 315.5, 206/315.6

[56] References Cited

U.S. PATENT DOCUMENTS

| | | | |
|---|---|---|---|
| 1,227,657 | 5/1917 | Pierce | 206/315.6 |
| 1,236,313 | 8/1917 | Keblinger | 206/315.6 X |
| 1,726,245 | 8/1929 | Shelton | 206/315.6 X |
| 1,788,478 | 1/1931 | Beaty et al. | 206/315.6 |
| 1,798,638 | 3/1931 | Stone et al. | 206/315.5 |
| 1,809,536 | 6/1931 | Tucker | 206/315.6 X |
| 1,840,183 | 1/1932 | Blich | 206/315.6 |
| 2,009,072 | 7/1935 | Sampson | 206/315.6 X |
| 2,023,792 | 12/1935 | Sampson | 206/315.6 X |
| 2,256,521 | 9/1941 | Kiripatrick et al. | 206/315.3 |
| 2,294,084 | 8/1942 | Gihon, III et al. | 206/315.6 |
| 2,546,416 | 3/1951 | Alter et al. | 206/315.6 |
| 2,568,810 | 9/1951 | Kish, Jr. | 206/315.6 |
| 2,752,973 | 7/1956 | Stamp | 206/315.6 |
| 3,455,258 | 7/1969 | Kuzma | 206/315.6 |
| 3,729,036 | 4/1973 | McFadden | 206/315.6 |
| 4,172,484 | 10/1979 | Henning | 206/315.6 |
| 4,311,178 | 1/1982 | Kennedy | 206/315.6 |
| 4,691,823 | 9/1987 | Pape | 206/315.6 |
| 4,709,814 | 12/1987 | Antoious | 206/315.6 X |
| 4,911,292 | 3/1990 | Airey, Jr. | 206/315.3 |
| 5,088,600 | 2/1992 | Kopp, Jr. | 206/315.6 X |
| 5,103,974 | 4/1992 | Antonious | 206/315.6 |
| 5,148,915 | 9/1992 | Ryan | 206/315.6 |
| 5,226,533 | 7/1993 | Antonious | 206/315.6 |
| 5,255,781 | 10/1993 | Dulyea | 206/315.6 |
| 5,279,414 | 1/1994 | Brasher | 206/315.6 |
| 5,392,907 | 2/1995 | Blanchard et al. | 206/315.6 |
| 5,402,883 | 4/1995 | Shin | 206/315.6 X |
| 5,447,228 | 9/1995 | Hodgson, III | 206/315.6 X |
| 5,505,300 | 4/1996 | Joh | 206/315.6 |
| 5,573,112 | 11/1996 | Kim | 206/315.6 |
| 5,662,058 | 9/1997 | Wang | 206/315.6 X |
| 5,671,843 | 9/1997 | Sutter | 206/315.6 |

FOREIGN PATENT DOCUMENTS

| | | | |
|---|---|---|---|
| 216273 | 10/1955 | Australia | 206/315.5 |
| 428118 | 8/1911 | France | 206/315.5 |
| 1479 | 1/1905 | United Kingdom | 206/315.5 |
| 8333 | 2/1911 | United Kingdom | 206/315.5 |
| 349310 | 5/1931 | United Kingdom | 206/315.5 |
| 705115 | 3/1954 | United Kingdom | 206/315.5 |
| 2130102 | 5/1984 | United Kingdom | 206/315.6 |

OTHER PUBLICATIONS

"Golf Shop Operations", A Golf Digest Publication, Apr. 1990, Organizer on p. 124 sold by QS.

*Primary Examiner*—Sue A. Weaver
*Attorney, Agent, or Firm*—Curtis L. Harrington

[57] ABSTRACT

The golf bag has an inner portion and an outer portion. The inner portion has a first variation of which several embodiments are shown having from 12 to 15 storage spaces. a second variation has 14 spaces subdivided by three linear parallel chords across the circular collar of a golf bag. Both configurations provide a golf club storage configuration which helps circumferentially distribute the load from the weight of the clubs about the internal periphery of the golf bag, while providing an aesthetically pleasing fanciful pattern. The inner section is made up of material sewn along the axial length of the inner section and which may be supported by a more rigid tubular exterior, or which may be anchored.

15 Claims, 9 Drawing Sheets

45
47
49
47
49
53
55
55
53
53
53
55
55
53
53
75

GOLF BAG DIVIDER CONSTRUCTION

This is a Continuation-in-Part of U.S. patent application Ser. No. 08/740,193 filed on Oct. 24, 1996, U.S. Pat. No. 5,785,173 which was a divisional of then U.S. patent application Ser. No. 08/561,896 filed on Nov. 22, 1995, U.S. Pat. No. 5,573,112.

FIELD OF THE INVENTION

The present invention relates to the field of sporting goods and equipment. More specifically, the present invention relates to embodiments of a golf bag and method of making which subdivides the central containment area of the golf bag into individual compartments which extend the full length of the golf bag, and which provides for stabilization of a series of inner sections which may fit into a common outer portion.

BACKGROUND OF THE INVENTION

Conventional golf bags have a central containment volume in the form of an elongate cylindrical space. Typically the top or entrance of the golf bag may be reinforced with structures tending to divide only the entrance of the contained volume. While a subdivision of only the entrance of the golf bag helps to protect the club heads to a degree, the club shafts within the bag are free to bump and scratch each other. Further, the extent of the subdivision of the space at the entrance of the golf bag is typically limited to three or six openings. This number does not provide even separation of the clubs, which must be stored at least two clubs per opening. The opening subdivision structure also tends to have thick dividing members which restrict the entrance opening into the golf bag. Consequently a larger number of small subdivided spaces equates to a lesser overall opening space into the golf bag.

Many prior golf bags have attempted division of the bag space, but none have been as effective as shown in the types of techniques illustrated in U.S. Pat. No. 5,573,112 issued to Jin C. Kim. In it, the sub divisions are arranged for efficient manufacture and to provide a stable support for the space subdivided within a golf bag. Efficient division of the space within a golf bag should provide for even division of the cross sectional entrance area, as well as result in an even balance of the golf clubs carried within the bag. The Jin C. Kim bag enabled full-length protection for clubs, combined with an ultra light weight.

Other configurations and combinations are needed in order to provide a wider variety of efficient subdivisions of the golf bag area while also accomplishing other goals as well. These goals include sufficient support at the bag entrance of the upper divisions, as well as between the individually divided portions. Other problems to be solved include the provisions of dividers in conjunction with bag stands and the provision of bags intended to be carried on the shoulder and which will assume a narrow middle dimension when carried from the shoulder, limited only by the number and disposition of clubs carried within the bag.

SUMMARY OF THE INVENTION

The golf bag has an inner portion and an outer portion. The inner portion has a first variation of which several embodiments are shown having from 12 to 15 storage spaces. A second variation has 14 spaces subdivided by three linear parallel chords across the circular collar of a golf bag. Both configurations provide a golf club storage configuration which helps circumferentially distribute the load from the weight of the clubs about the internal periphery of the golf bag, while providing an aesthetically pleasing fanciful pattern. The inner section is made up of material sewn along the axial length of the inner section and which may be supported by a more rigid tubular exterior, or which may be anchored.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
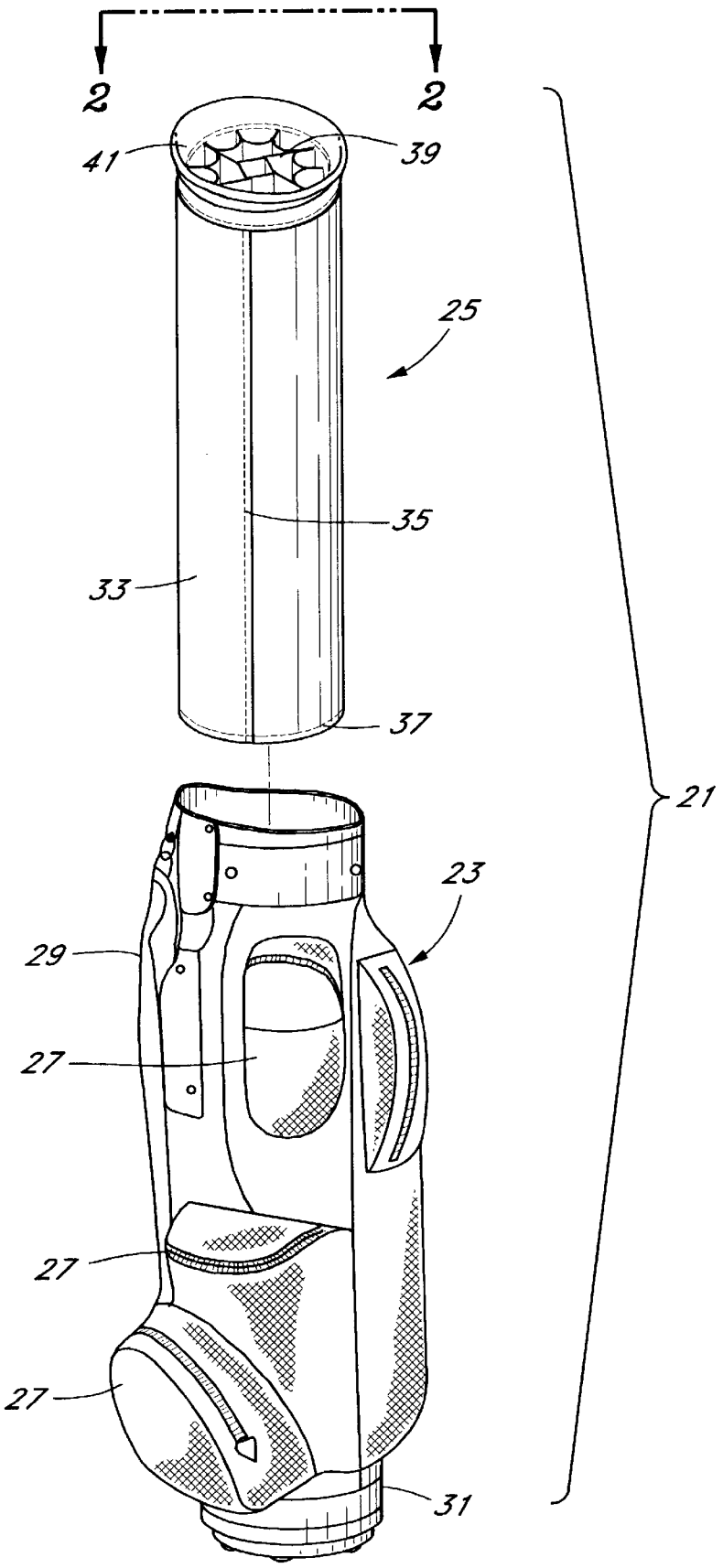
FIG. 1 is a perspective exploded view of a first embodiment of the golf bag of the present invention and illustrated with the inner section above the main golf bag outer portion.

The description and operation of the invention will be best described with reference to FIG. 1. FIG. 1 is an exploded view of a golf bag 21 of the present invention which generally includes an outer portion 23 and an inner section 25. The golf bag housing or outer portion 23 is a shell which may be formed in a conventional manner. The outer portion 23 has various compartments 27, as well as a carrying strap 29. The compartments 27 are typically closable as by zippers, snaps, and the like. The compartments 27 are typically used to carry extra towels, golf balls and tees. The outer portion 23 also may have a base 31 which may have structures to protect the bag 21 when it is placed on the ground.

The inner section 25 includes an outer relatively rigid covering portion 33 which includes a vertical length of stitching 35 to form the covering portion 33 into a cylinder. Stitching 35 is shown in dashed line format, as is all stitching the drawings whether identified by number or not. The bottom periphery of the covering portion 33 has stitching 37 to hold the internal compartments of the inner section 25 in an open position.

At the top of the inner section 25 is a fancifully shaped upper divider pattern 39 which may correspond to the shape of the cloth compartments formed below, and which is suspended within a collar 41. The upper portion of the divider pattern 39 is configured for its pleasing shape and balanced aesthetic. The provision of a fanciful exterior divider pattern provides a challenge to meet this fanciful pattern with the provision of interior space which must work properly. The upper divider pattern 39 may be provided without any further internal compartments and the aesthetic may be achieved. However, the present application is concerned with the manner in which the separate internal compartments are formed.

Figure 2:
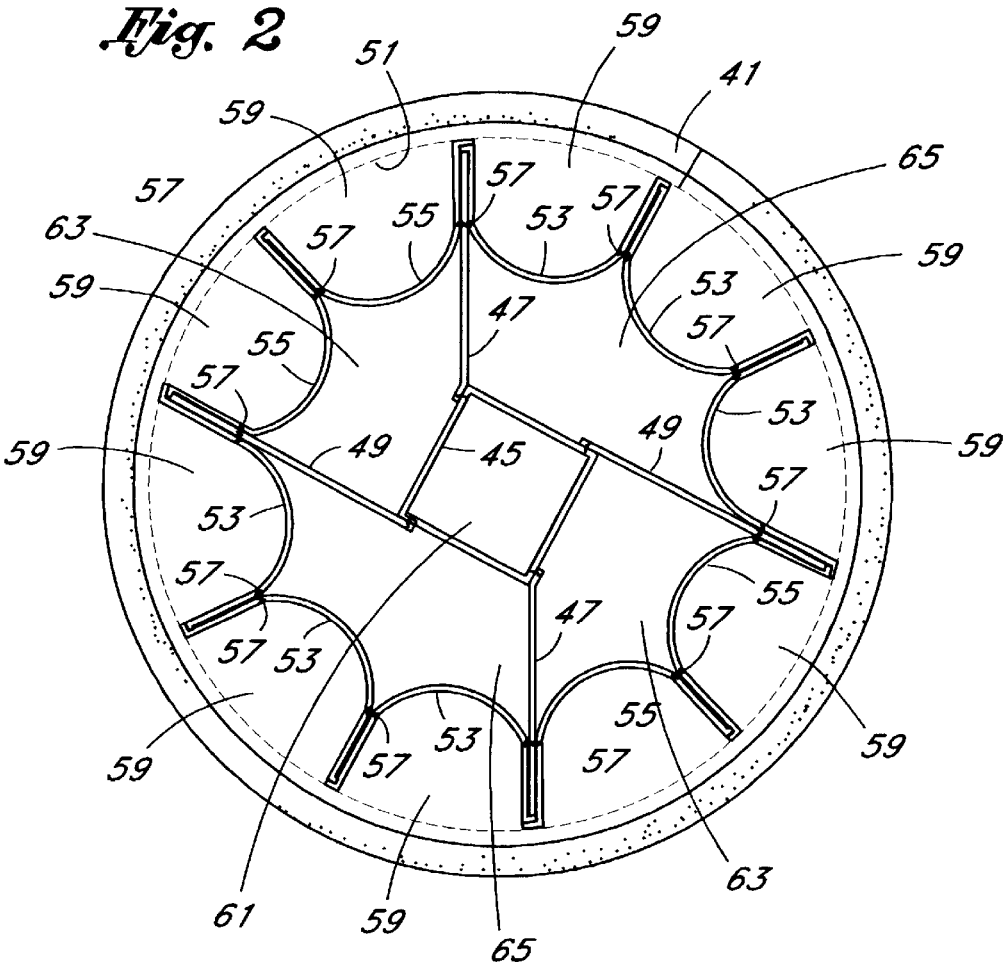
FIG. 2 is a downward view into an assembled golf bag which was shown in FIG. 1, and as can be seen there are 15 formed compartments, 10 about the periphery of the bag, 4 distributed inward of the periphery, and a square center compartment.

Referring to FIG. 2, a top view looking down into the inner section 25 illustrates the fanciful pattern as having a central square or nearly square core 45. The same distribution and arrangement of compartments could be made using an infinite number of patterns, such as completely angled shapes or completely round shapes, or any combination thereof. On two opposite ends of the core 45 a pair of portions 47 extend away from core 45 nearly at a middle angle with respect to the core to almost form a "y" shape. On the other two opposite ends of the core 45 a pair of portions 49 extend away from the core 45 at an angle nearly parallel to the wall of the core 45 from which it departs. Note that each of the portions 47 and 49 leave their associated surface of the cor 45 at parallel position, but that the angles of the portions 47 and 49 differ with respect to the core.

Collar 41 has an inside surface 51 to which the ends of the portions 47 and 49 not attached to the core 45 are attached. A series of arc portions, including a series of three arc portions 53 occurring in a group and a series of two arc portions 55 occurring in a group. The arrangement about the periphery of the inside surface 51 includes a group of three arc portions 53, followed by a group of two arc portions 55, followed by a second group of three arc portions 53, and then followed by a second a group of two arc portions 55.

Where a pair of portions 47 and 49 are separated by a group of three arc portions 53, the portion 49 will tend to depart the core 45 oriented parallel to two of the sides of the core 45, and portion 47 tends to form a "y" (small case) with regard to the walls of the core 45 from which it depends. This configuration is stable and when a manual attempt to twist it clockwise is made, it springs back into shape. When an attempt to twist it counterclockwise is made, the portions 49 exert a pulling moment which resists such movement. As such, the fanciful pattern shown in FIG. 2 is not expected to change with time, even though made with non-rigid materials.

Each of the arc portions 53 and 55 are joined to an adjacent pair of arc portions 53 or 55 with a stabilization stitch 57. Stabilization stitch 57 prevents the adjacent edges of the arc portions 53 and 55 from "bowing away" from each other.

The pattern formed by the design of FIG. 2 includes a series of peripheral arc shaped spaces 59 of equal area. The core 45 has a core space 61 of square shaped area. A pair of smaller intermediate spaces 63 are formed between the core 45 and the arc portions 55, while a pair of larger intermediate spaces 65 are formed between the core 45 and the arc portions 53. The resulting fanciful pattern is symmetrical.

Since cloth material does not form a good bond based upon point contact, the end segments immediately facing the observer of FIG. 2 are formed to help to better hold the materials in a sewn fashion. Although not explicitly shown in FIG. 2, a thin length of felt or other aesthetically pleasing material foldably surrounds and is immediately connected to the lengths of material forming portions 45, 47, 49, 53, & 55, to enable the end of the inner section 25 to withstand wear.

Figure 3:
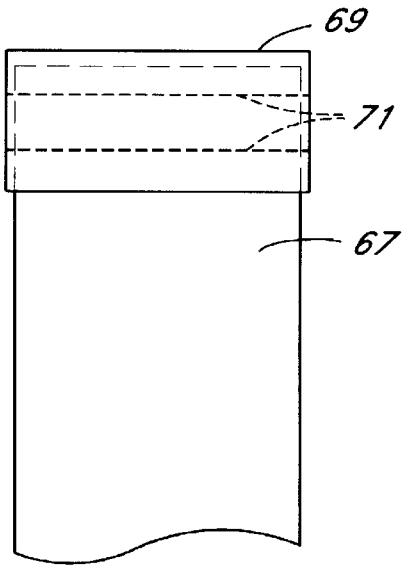
FIG. 3 is a typical length of material which is incorporated into the golf bag of the present invention and is shown being fitted at its upper end with a fold of reinforcing material.

FIG. 3 illustrates a length of material 67 which may be a length of material from which any of the portions 45, 47, 49, 53, & 55 are formed. The lengths of material 67 from which portions 45, 47, 49, 53, & 55 are formed differ only in their width.

A small piece of reinforcing material 69 is stitched to the top end of the length of material 67 using a pair of stitches 71. The reinforcing material 47 may be felt or corduroy or other aesthetically pleasing material. The purpose of the reinforcing material 69 is twofold. First, it provides some stiffening and reinforcing influence on the top of the divider group. Secondly, it can provide a finishing layer which will give an improved appearance to the fanciful pattern best seen in FIG. 2. Identification of the reinforcing material was deliberately omitted from FIG. 2 in order to simplify the explanation thereof.

Figure 4:
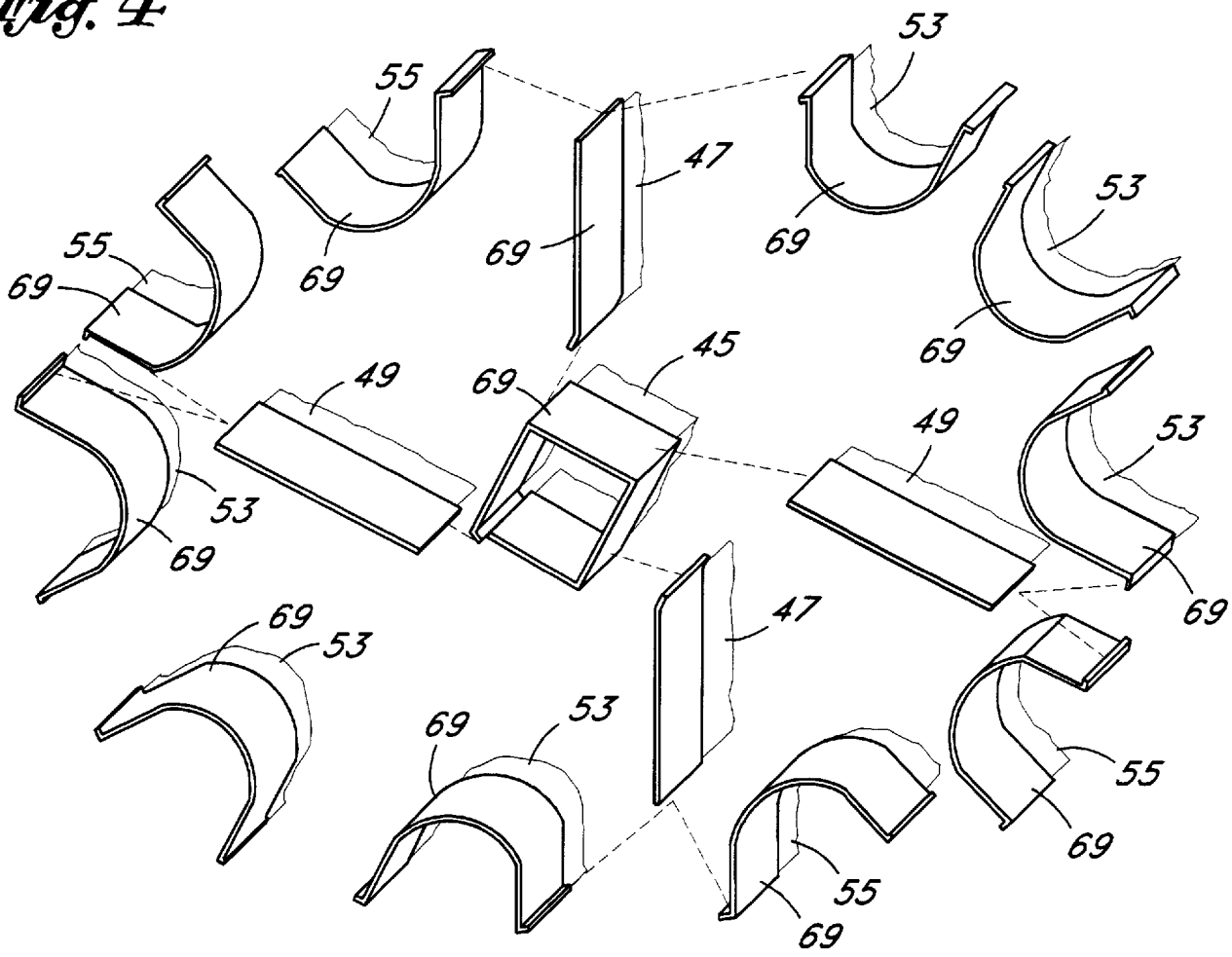
FIG. 4 illustrates a perspective end view of the segments which are joined together to form the divider system shown in FIGS. 1 and 2.

Referring to FIG. 4, an exploded perspective view of the ends of the portions 45, 47, 49, 53, and 55 is shown. Ideally, the lengths of material 67 forming portions 45, 47, 49, 53, and 55 and 45 will be sewn with one edge of the rectangular material 67 at a time, beginning with the center portion 45 and where the closure of the center portion 45 occurs along with the attachment of the portion 49.

Figure 5:
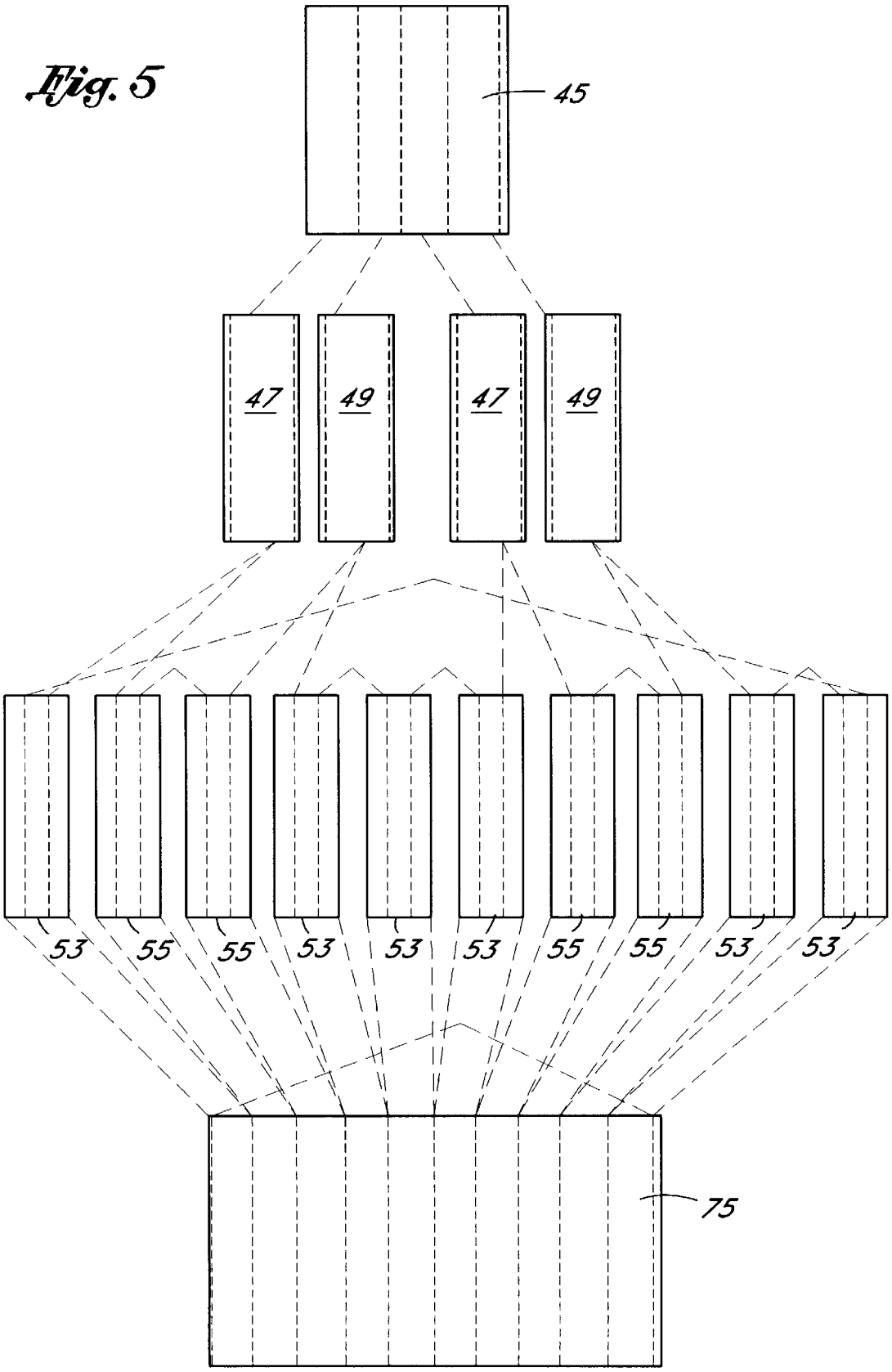
FIG. 5 is a schematic diagram which illustrates the formation of the divider shown in FIGS. 1, 3, & 4 from individual lengths of material and illustrates the manner in which the component parts are sewn.

Referring to FIG. 5, the portions 45, 47, 49, 53, and 55 are shown as individual lengths of material, and the dashed lines illustrate the manner in which the materials are attached. Seen for the first time is a soft surrounding layer 75 which is will be integrated with the inner surface 51 of the collar 41 in order to complete the assembly.

Referring to FIG. 5, the formation of a collar 41 is shown. The collar 41 is made up of three layers of material. These materials have an area of expanse, although the term length will be used for simplicity. As can be seen in the Figures, the area of expanse must be sufficient to cover the inside and outside of the golf bag 21 structures with which the material is associated. A well-finished, rubber backed material 77 is sewn and arranged to be folded over the line of joinder of the three materials to form a soft, attractive rim. A second length of material 79 is made of relatively thin, relatively rigid material, such as polyvinyl chloride. This material will support being sewn to the portions 45, 47, 49, 53, and 55 previously shown in FIGS. 1–4.

Between the rubber backed material 77 and the inner second length of material 79 is a length of ring accommodating material 81.

As can be seen, rubber backed material 77 is oriented such that the rubberized side faces and is joined to ring accommodating material 81. This enables the rubber backed material 77 to be brought upward and around the seam where it is joined to material 79 and to the edges of portions 47, 49, 53, and 55 which face the inner surface 51 of the collar 49 as they are sewn down along side the inside of material 77.

The length of ring accommodating material 81 has a gentle groove 83 along its length which will accommodate a welded ring between the ring accommodating material 81 and the second length of material 79.

It is preferable for the thin length of covering material 75 to be incorporated into the divider structure at the same time in which the collar 49 is formed, and also while the assembly of FIG. 4 is formed. The upper edge of the thin length of covering material 61 is preferably captured between the second length of material 79 on the outside and the rubber backed material 77. This sewing step could be facilitated by using a form or other structure to hold the layers together during sewing.

In some cases only a limited extent of the upper edge of the thin length of covering material 61 need be captured between the second length of material 79 and the rubber backed material 77, to facilitate this sewing procedure. The soft surrounding layer 75 may be made of very thin material, to facilitate the capturing described above. The layer 75 is preferably be made slightly longer than the portions 45, 47, 49, 53, and 55, to match the bottom length of the rigid covering portion 33 shown in FIG. 1, while providing, and to provide for enough of the material above the rigid covering portion 33 to enable the capturing described above.

At the lower end of the inner section 25, this enables the end of the portions 45, 47, 49, 53, and 55 to be recessed with respect to the bottom edge of the soft, thin surrounding layer 75, as well as the bottom edge of the rigid covering portion 33. This accomplishes several important functions. First, it enables the further sewing of a lower excess of the soft surrounding layer 75, of about one inch, which extends beyond the end of the lengths of portions 45, 47, 49, 53, and 55, to be sewn to the rigid covering portion 33. Second it may provide clearance for a rubber pad (not shown) which may be attached to the bottom of the outer portion 23. Third, the clearance will exceed the height of the rubber pad and will thus provide some further clearance between the portions 45, 47, 49, 53, and 55 so that the ends of the golf club grips will not continually rub the bottom edge of the portions 45, 47, 49, 53, and 55 with their edges. This will contribute to a longer life for the inner section 25 while not subjecting the grips to rubbing by the portions 45, 47, 49, 53, and 55.

Figure 7:
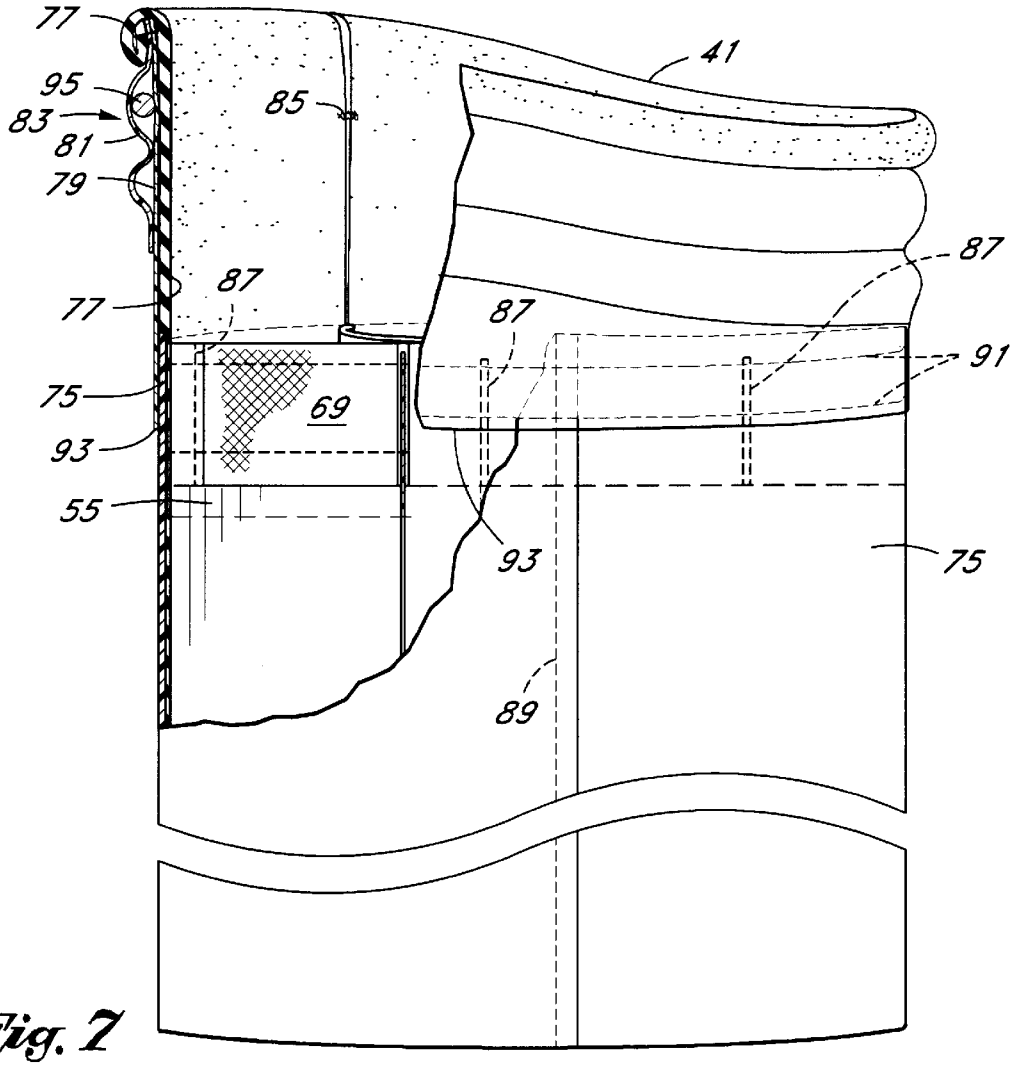
FIG. 7 is a side, semi-sectional view and illustrating the addition of the collar to a soft outer cylindrical layer being sewn to the structure and including reinforcement sewing at each place where the divider structure contacts the collar.
Figure 6:
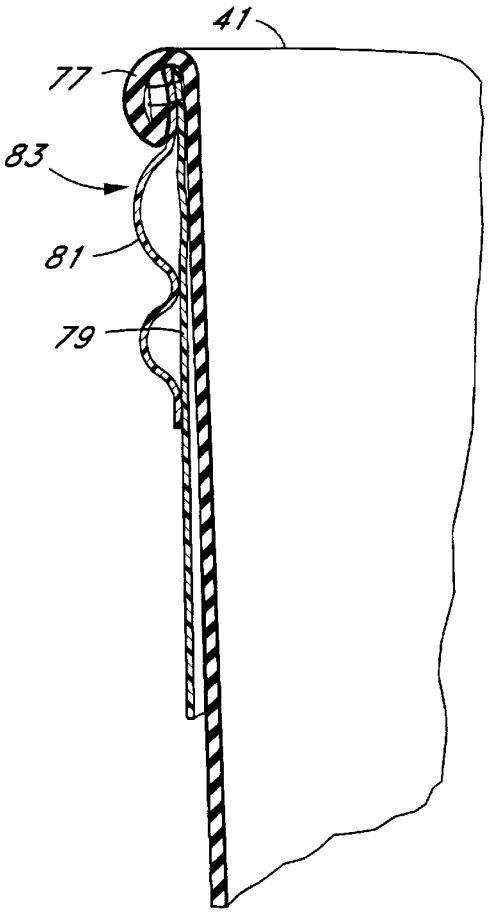
FIG. 6 is a side sectional view illustrating the formation of a including the attachment of a soft material to the outside which is folded around to an inside position to give a finished appearance.

Referring to FIG. 7, the materials at the upper left of the collar can still be seen. A joining stitch 85 joins the material of the collar 41 together. This stitch 85 and the edges it joins will normally not be seen on the finished golf bag 21 since it is usually covered with a ring strap having a ring which is used to attach a carrying strap 29.

A series of short butt-end vertical stitches 87 join the butt ends of the reinforcing material 69 to the rubber backed material 77 and the second length of material 79 while the upper edge of the soft surrounding layer 75 is captured. A vertical elongate stitch 89 completes and closes the soft surrounding layer 75 into a tube. A series of circumferential stitches 91 are used to capture the upper edge of the soft surrounding layer 75. A bottom edge 93 of the second length of material 79 will abut an upper edge of the rigid covering material 33 if such rigid covering material 33 is used for stabilization.

Also shown is a ring 95 being brought into place to be moved over the soft surrounding layer 75 and outside of the second length of material 79, but inside the softer length of ring accommodating material 81 of the collar 41. The softer length of ring accommodating material is typically trimmed just below the second curved portion seen. Also, the collar 41 is shown in a sloped relationship. The ring 95 may be bent to help form a sloping shape of the collar 41. The ring 95 is typically about one fourth of an inch in diameter and may have welded ends rather than to be formed of a single length of material. The ring 95 rests against the second length of material 79 and within the groove in the softer length of ring accommodating material 81. The groove enables the ring 67 to be retained in place, especially once the inner section 25 is brought to rest within the outer portion 23, to create clamping forces on the upper part of the inner section 25.

Once the structure shown in FIG. 7 is formed, it has no rigid covering portion 33 as was shown in FIG. 1. The rigid covering portion 33 should preferably be made of a relatively thin layer of polyvinyl chloride. A length of such material is readily made into a cylinder by the use of the elongate stitch 35. The bulk of the lengths of material 67 from which the portions 45, 47, 49, 53, and 55 are formed and which form the inner section 25 structure beneath the collar 41 are then slipped into the covering portion 33.

Ideally the diameter of the covering portion 33 will somewhat match the diameter of the second length of material 79 so that neither one will "jam" into the other. The covering portion 33 is attached to the thin length of soft surrounding layer 75 adjacent the bottom edge of the material forming the layer 75, and covering portion 33 has an upper edge 97. Thus, the covering portion 33 will be able to rotate about one fourth of an inch or less against the second length of material 79. As rotation occurs, the upper edge 97 will move up into contact with the lower edge 93 of the second layer of material 79.

Figure 8:
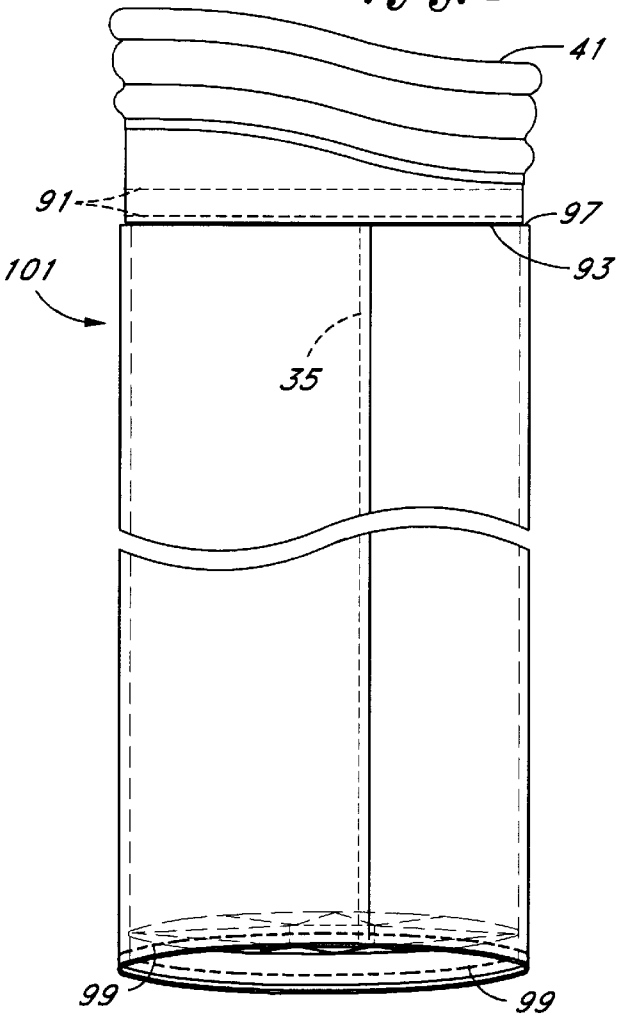
FIG. 8 is one method of construction using a lower plastic insert and attachment structure.

Also shown in FIG. 8, is a perspective view of the bottom of the inner section 25 showing how the bottom of the inner section 25 includes attachment of the soft surrounding layer 75 to the rigid covering portion 33. A single bottom stitch 99 surrounds the bottom periphery of the inner section 25 joining the thin soft surrounding layer 75 to the rigid covering portion 33. In this manner, the rigid covering portion 33 tends to anchor the thin soft surrounding layer 75, which in turn stabilizes the portions 45, 47, 49, 53, and 55.

The resulting structure leaves the only connection that the collar 51 will have with the rigid covering portion 33 to be through the thin length of soft surrounding layer 75. The fact that the rigid covering portion 33 has an upper edge 97 which abuts the lower edge 93 of the collar 41 will be sufficient to keep the structure of the portions 45, 47, 49, 53, and 55 in tact. Preferably, the vertical stitching 35 does not join the rigid covering portion 33 with the materials 41, 43, and 45 making up the inner section 25 structure. FIG. 8 illustrates a completely formed insert 101 which may function as one of the inner sections 23.

Figure 9:
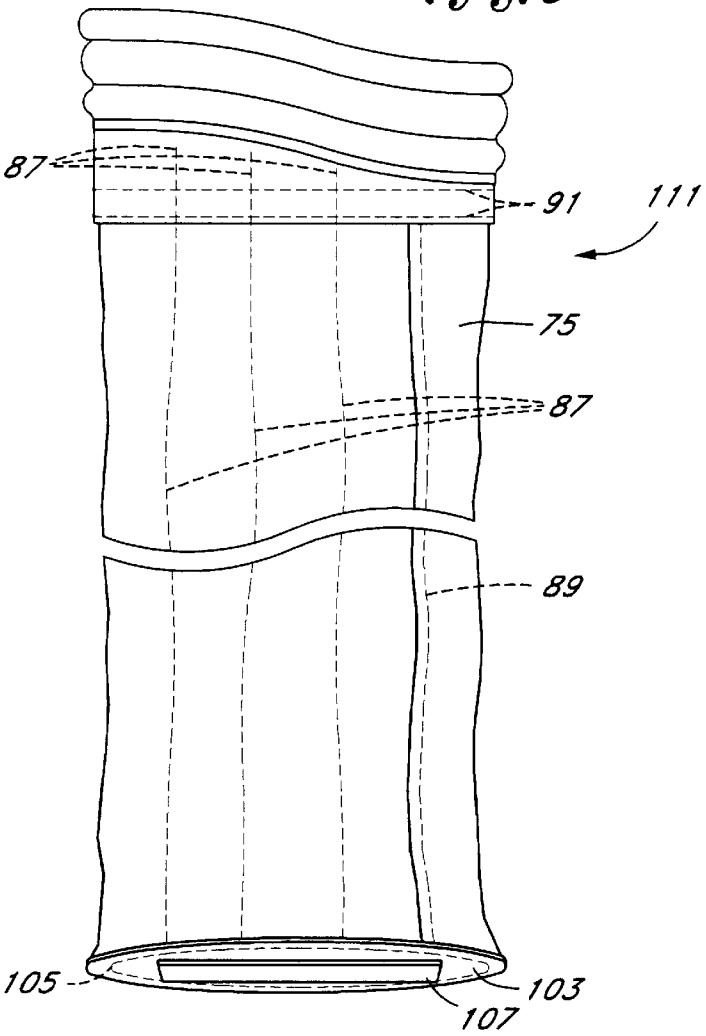
FIG. 9 is another alternative method of construction using a rigid bottom member with an attachment structure.

FIG. 9 illustrates an alternative embodiment for the exterior of any of any inner section 25 shown with respect to the present invention. In this embodiment, the rigid covering portion 33 is not added to form the exterior of the inner section 25, but is formed beginning with the structure seen in FIG. 7. Seen in FIG. 9 are the series of butt-end vertical stitches 87 which extend downward beyond just the lower portion of the second length of material 79, and which join the end edges of the portions 45, 47, 49, 53, and 55 to the thin length of soft surrounding layer 75. As can be seen, the material below the collar 41, including the portions 45, 47, 49, 53, and 55 must be to be held in their proper shape once the thin length of soft surrounding layer 75 is pulled down and into place by the rigid covering portion 33 shown in FIG. 7.

However, for FIG. 9, a planar expanse of material 103 is joined to the thin length of soft surrounding layer 75. The method of joining is by a circular stitch 105 which engages the thin length of soft surrounding layer 75, adjacent its lower edge, as it is flared out parallel to the planar length of material 103.

The tension or downward anchoring necessary to keep the inner section 25 in a somewhat tensive and straight position may be had through a patch of material 107 which may be either one of an area of hook-like and felt like material to engage the other of hook-like or felt-like material which would be in place at the bottom of the outer portion 23. Both pieces of material 107 would preferably be attached to their support surfaces with adhesive, although it may be sewn to the planar length of material 103. As golf clubs are continued to be loaded into the completed golf bag 21, the material 107 will become even more attached and even further stabilize the inner section 25. The structure shown in FIG. 9 is a completed insert 111 which may function as an alternative one of the inner sections 25.

Figure 10:
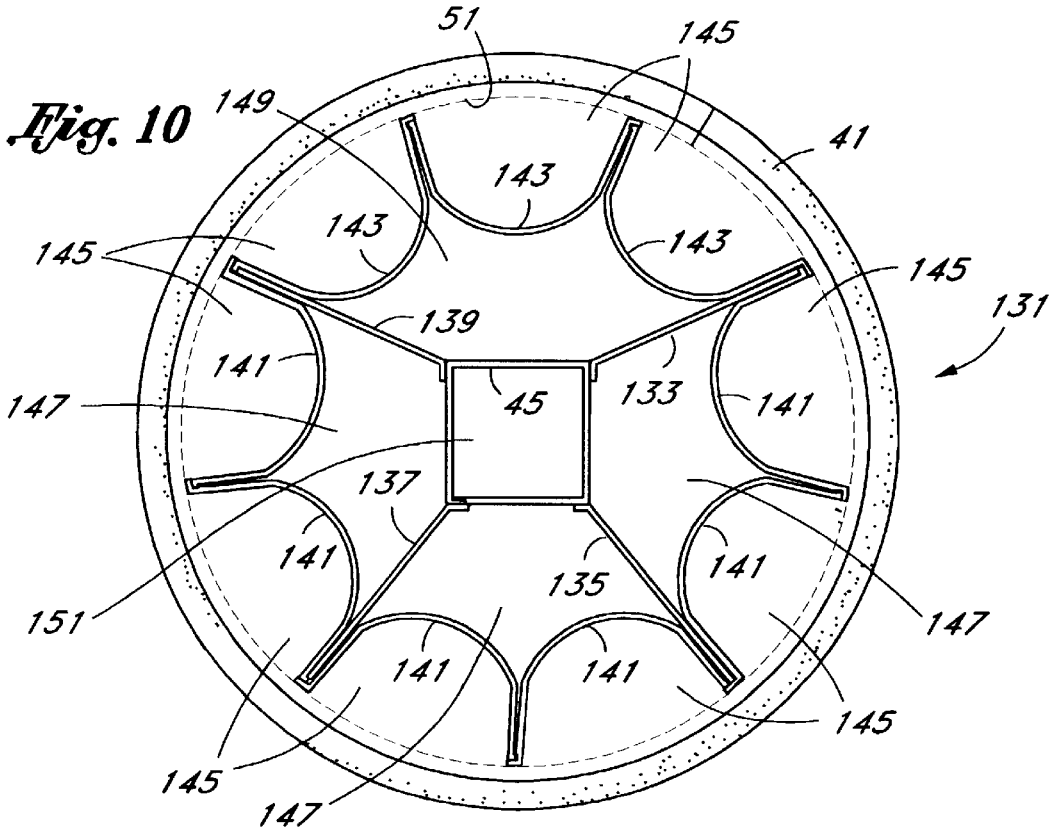
FIG. 10 is a downward view into a variation of the view of FIG. 2 and illustrating an assembled golf bag having 14 formed compartments, 9 about the periphery of the bag, 4 distributed inward of the periphery, and a square center compartment, and wherein one of the 4 compartments distributed inward of the periphery has 3 peripheral compartment associated with it, the remaining three of the compartments distributed inward of the periphery each having 2 peripheral compartments associated with it.

FIG. 10 illustrates an end view, looking down into f a second embodiment of a fanciful appearance of an inner section 131, similar to the perspective taken for FIG. 2, and which may have a construction in accord with that shown for insert 101 or insert 111. The inner section 131 has a fanciful pattern as having a central square or nearly square core 45. The same distribution and arrangement of compartments could be made using an infinite number of patterns, such as completely angled shapes or completely round shapes, or any combination thereof. The core 45 of inner section 131, however has bi-lateral symmetry only along a single plane. Each corner of the core portion 45 has a portion extending away from it, namely portion 133, 135, 137, and 139. About the periphery of the collar 41 of the inner section 131, a series of three pairs of arc portions 141 are grouped between the portions 133 & 135, 135 & 137, and 137 & 139. Between the portions 133 and 139 are grouped a single set of three adjacent arc portions 143. This results in the fanciful pattern seen in FIG. 10 having bi-lateral symmetry extending through the middle one of the arc portion 143, and between the arc portions 141 between the portions 135 and 137. The inner section 131 shows arc shaped spaces 145 of equal area, Three blunt wedge shaped spaces 147 of approximately equal area, and an end blunt wedge shaped space 149 of greater area than the spaces 147, as well as a core space 151 of square shaped area. Spaces 145, 147, 149, and 151 total 14 in number.

The formation of the structures shown in FIG. 10 are similar to the manner of construction shown in FIG. 4, and including the use of reinforcing material 69, which is not shown in FIG. 10 for clarity.

Figure 11:
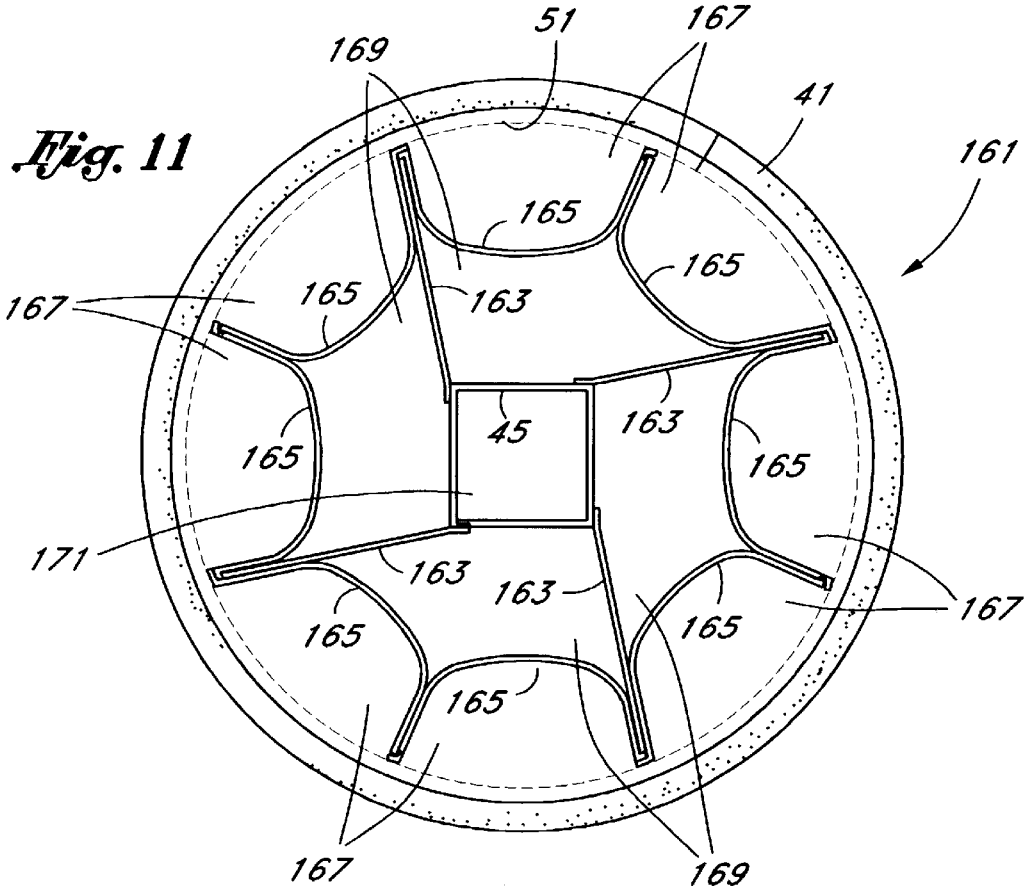
FIG. 11 is a downward view into another variation of the view of FIGS. 2 and 10 and illustrating an assembled golf bag having 13 formed compartments, 8 about the periphery of the bag, 4 distributed inward of the periphery, and a square center compartment, and wherein each one of the 4 compartments distributed inward of the periphery has 2 peripheral compartments associated with it.

FIG. 11 illustrates an end view, looking down into a third embodiment of a fanciful appearance of an inner section 161, similar to the perspective taken for FIGS. 2 and 10, and which may have a construction in accord with that shown for insert 101 or insert 111. The inner section 161 has a fanciful pattern as having a central square or nearly square core 45. Again, the same distribution and arrangement of compartments could be made using an infinite number of patterns, such as completely angled shapes or completely round shapes, or any combination thereof. The core 45 of inner section 161, however has bi-lateral symmetry along all planes extending down into the inner section 161. Each corner of the core portion 45 has a portion 163 extending away from it, and attached to the core 45 at a nearly parallel angle.

About the periphery of the collar 41 of the inner section 161, a series of pairs of arc portions 165 are grouped between adjacent portions 163. This results in the fanciful pattern seen in FIG. 11. The inner section 161 shows arc shaped spaces 167 of equal area, four offset wedge shaped spaces 169 of approximately equal area and a core space 171 of square shaped area. Spaces 167, 169, & 171 total 13 in number.

The formation of the structures shown in FIG. 11 are similar to the manner of construction shown in FIGS. 4, and including the use of reinforcing material 69, which is not shown in FIG. 11 for clarity.

Figure 12:
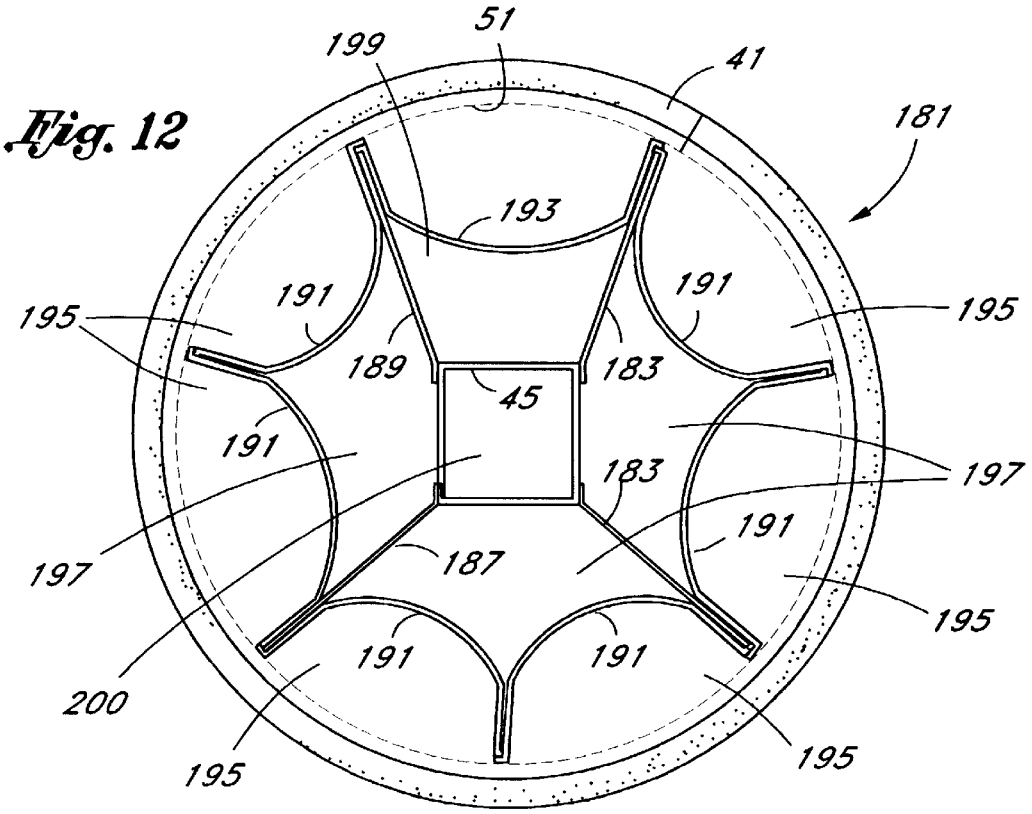
FIG. 12 is a downward view into another variation of the view of FIGS. 2, 10, & 11 and illustrating an assembled golf bag having 12 formed compartments, 7 about the periphery of the bag, 4 distributed inward of the periphery, and a square center compartment, and wherein 3 of the 4 compartments distributed inward of the periphery has 2 peripheral compartments associated with it and one of the 4 compartments has only a single peripheral compartment associated with it.

FIG. 12 illustrates an end view, looking down into f a fourth embodiment of a fanciful appearance of an inner section 181, similar to the perspective taken for FIG. 2, and which may have a construction in accord with that shown for insert 101 or insert 111. The inner section 181 has a fanciful pattern as having a central square or nearly square core 45. The same distribution and arrangement of compartments could be made using an infinite number of patterns, such as completely angled shapes or completely round shapes, or any combination thereof. The core 45 of inner section 161, however has bi-lateral symmetry only along a single plane. Each corner of the core portion 45 has a portion extending away from it, namely portion 183, 185, 187, and 189. About the periphery of the collar 41 of the inner section 181, a series of three pairs of arc portions 191 are grouped between the portions 183 & 185, 185 & 187, and 187 & 189. Between the portions 183 and 189 are grouped a single arc portions 193. This results in the fanciful pattern seen in FIG. 10 having bi-lateral symmetry extending through the middle of the arc portion 193, and between the arc portions 191 between the portions 185 and 187. The inner section 181 shows arc shaped spaces 195 of equal area, Three blunt wedge shaped spaces 197 of approximately equal area, and an end blunt wedge shaped space 199 of greater area than the spaces 197, as well as a core space 200 of square shaped area. Spaces 195, 197, 199, and 200 total 12 in number.

The formation of the structures shown in FIG. 12 are similar to the manner of construction shown in FIG. 4, and including the use of reinforcing material 69, which is not shown in FIG. 12 for clarity.

Figure 13:
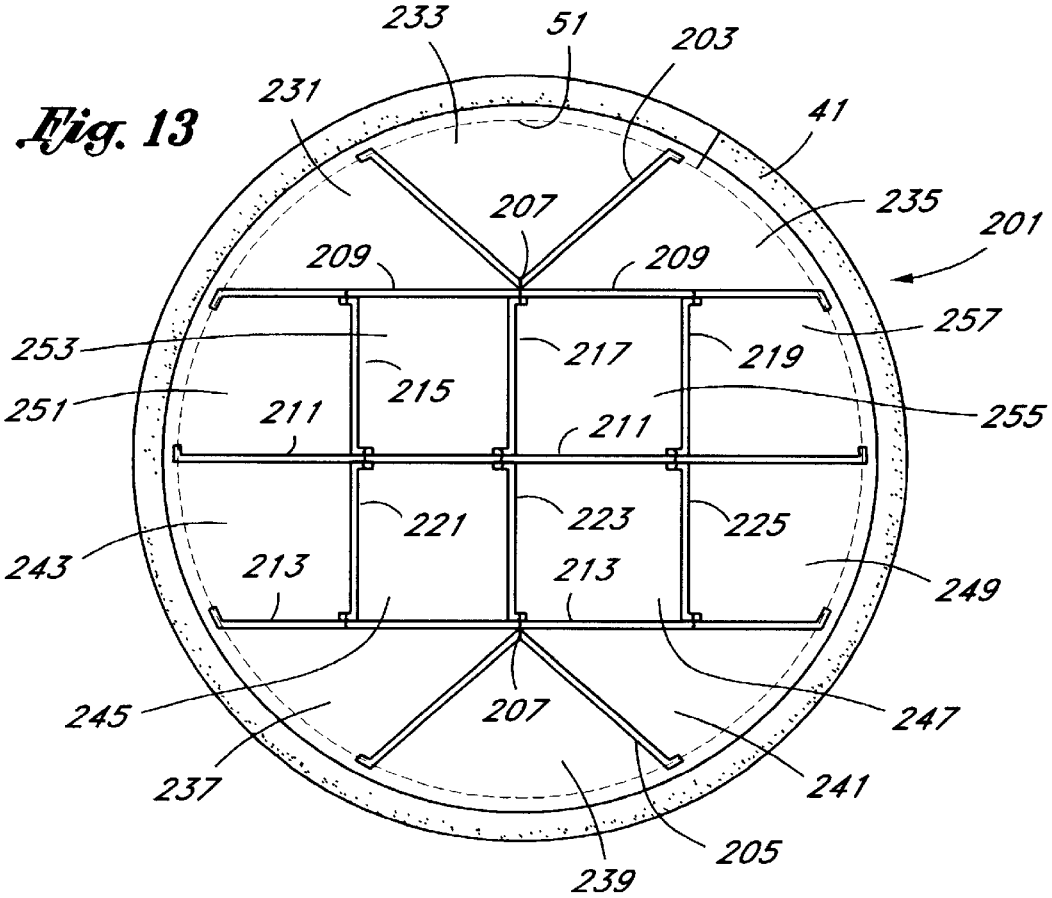
FIG. 13 is a completely different version of an inner section of the bag of the present invention having a series of eight almost square compartments across the center and three almost triangular compartments on either side of the almost square compartments.

Referring to FIG. 13, a top view looking down into an inner section 201 illustrates the fanciful pattern as having two rows of four nearly square compartments which end against the round inner surface 51 of the collar 41. On the other two sides of the two rows, the compartments on either side of the rows are sub-divided by a "V" shaped portion.

Referring to FIG. 13, the top of the Figure has a first "V" shaped portion 203 while the bottom of the Figure has a second "V" shaped portion 205. Portions 203 and 205 may be made of a single length of material sewn at the angular portion of the "V" shape, 207.

A first linear portion 209, second linear portion 211 and third linear portion 213 extend in parallel each from one side of the collar 41 to the other. A first series of three cross portions including first cross portion 215, second cross portion 217 and third cross portion 219 extend at right angles between portions 209 and 211. A second series of three cross portions including fourth cross portion 221, second cross portion 223 and third cross portion 225 extend at right angles between portions 211 and 213.

The pattern formed by the design of FIG. 13 includes a series of spaces including a first, second and third fourth, fifth and sixth triangular space 231, 233, 235, 237, 239 and 241. Between portions 209 and 211 are spaces 243, 245, 247, and 249. Between portions 211 and 213 are spaces 251, 253, 255, and 257.

Figure 14:
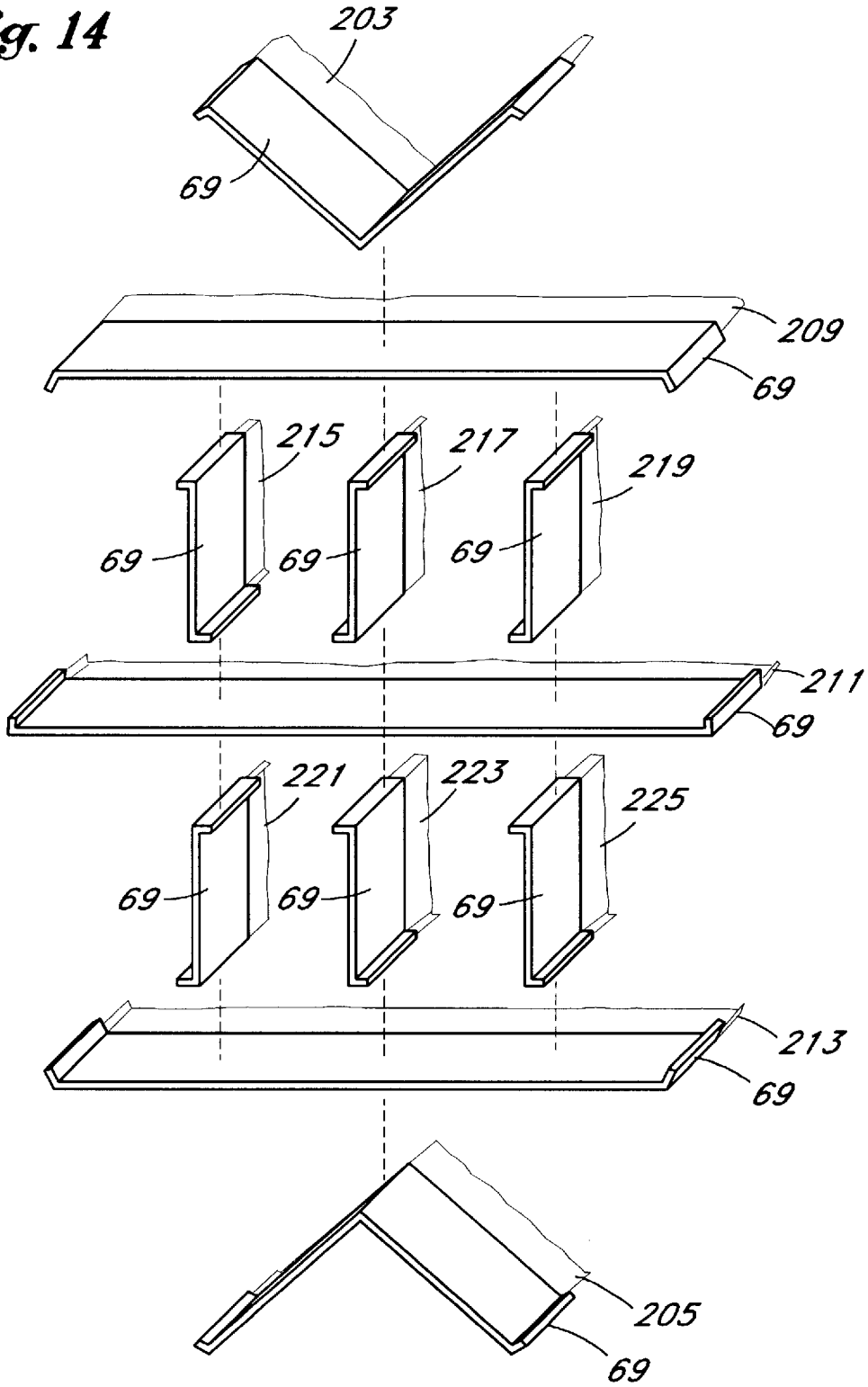
FIG. 14 is an exploded view of the embodiment of FIG. 13 and illustrating the construction of the components of the inner section.

Referring to FIG. 14, an exploded view illustrates the presence of the reinforcing material 69 as applied to the facing end of each of the portions 203–225 seen in FIG. 13. As can be seen, the exploded components indicate the construction thereof. Variations are possible, depending upon material availability. For example, instead of a single lengths of material as portion 211, four individual portions could be provided where each of the sets of portions 215 & 221, 217 & 223, 219 & 225 were each provided as a single length of material. Likewise, the portions 203 and 205 could have each been provided as a pair of individual portions of equal dimension.

While the present invention has been described in terms of a golf bag, and in terms of several embodiments of an interior portions to be inserted into an outer portion of a golf bag, as well as the method of construction of the inner sections, one skilled in the art will realize that the structure and techniques of the present invention can be applied to many appliances. The present invention may be applied in any situation where compartments are to be created which not only have an aesthetically pleasing pattern, but which provide a circumferentially balanced load resulting from placement of objects in the compartments.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A golf bag inner section comprising:

a rectangular inner portion having an upper first edge and a lower second edge;

a length of covering material having a first end having a first edge and a second end having a second edge which extends below said lower edge of said rectangular inner portion, said length of covering material surrounding said rectangular inner portion;

a plurality extension portions each having an upper first and a lower second edge and including at least a first outer edge and attached to said rectangular inner portion adjacent said first outer edge and a second outer edge and attached to said length of covering material adjacent said second outer edge;

a rigid covering portion surrounding said length of covering material and having a lower width adjacent a lower width of said length of covering material and attached to said length of covering material adjacent said lower width of said length of covering material; and a collar attached to said first end of said length of covering material.

2. The golf bag inner section as recited in claim 1 and further comprising a plurality of arc portions each attached to said length of covering material adjacent a first outer edge of said arc portion and adjacent a second outer edge of said arc portion opposite said first edge of said arc portion, said arc portions having upper first edges and lower second edges substantially co-extensive with the upper and lower edges of said rectangular portion and said plurality of extension portions.

3. The golf bag inner section as recited in claim 2 wherein said rectangular inner portion, said plurality extension portions and said plurality of arc portions each divide a volume within said inner section into a plurality of spaces.

4. The golf bag inner section as recited in claim 2 wherein said first edges of said rectangular inner portion, said plurality extension portions and said plurality of arc portions are covered with reinforcing material.

5. The golf bag inner section as recited in claim 2 wherein said rigid covering portion surrounding said length of covering material has an upper edge and wherein said collar has a lower edge abutting said upper first edge of said rigid covering portion.

6. The golf bag inner section as recited in claim 5 wherein said assembly further comprises a golf bag outer portion having an upper opening into a cylindrical space into which said golf bag inner section is insertably fixed, to form a completed golf bag.

7. The golf bag inner section as recited in claim 2 wherein said plurality of arc portions are located between adjacent pairs of said first outer edges of said plurality of extension portions.

8. The golf bag inner section as recited in claim 2 wherein said rectangular inner portion has four corners and each one of said plurality extension portions is attached at a different said corner.

9. The golf bag inner section as recited in claim 8 wherein a first oppositely disposed pair of extension portions extend away from their associated said corners of said rectangular inner portion in a "y" configuration and a second oppositely disposed pair of extension portions extend away from their associated said corners of said rectangular inner portion substantially parallel to an associated rectangular side of said rectangular inner portion.

10. A golf bag inner section for fixed insertion into a golf bag comprising:

a length of covering material formed into a rounded tube having an inside and an outside and having a first end having a first continuous edge about a first open end and a second end having a second continuous edge about a second open end;

a first plurality of linear portions having a first end having a first edge and a second end having a second edge which extends to a position above said second continuous lower edge, each of said first plurality of linear portions having a first side edge attached to and along a length of said inside of said covering material and a second side edge attached to and along a length of said inside of said covering material forming a chord when viewed from said first ends;

a second plurality of linear portions having a first end having a first edge and a second end having a second edge which extends to a position above said second continuous lower edge, each of said second plurality of linear portions having a first side edge attached to one of said first plurality of linear portions and a second side edge attached to a different one of said first plurality of linear portions.

11. The golf bag inner section as recited in claim 10 wherein said second plurality of linear portions are perpendicular to said first plurality of linear portions.

12. The golf bag inner section as recited in claim 10 and further comprising at least one angled portion having a first end having a first edge and a second end having a second edge which extends to a position above said second continuous lower edge, each of said at least one angled portions having a first side edge attached to and along a length of said inside of said covering material and a second side edge attached to and along a length of said inside of said covering material and an angle edge attached to and along a length of one of said first plurality of linear portions.

13. The golf bag inner section as recited in claim 12 and further comprising at least one third linear portion having a first end having a first edge and a second end having a second edge which extends to a position above said second continuous lower edge, each of said at least one third linear portions having a first side edge attached to and along a length of said inside of said covering material and a second side edge attached to and along a length of said first plurality of linear portions.

14. The golf bag inner section as recited in claim 10 wherein said first and second plurality of linear portions each divide a volume within said inner section into a plurality of spaces.

15. The golf bag inner section as recited in claim 10 wherein said assembly further comprises a golf bag outer portion having an upper opening into a cylindrical space into which said golf bag inner section is insertably fixed, to form a completed golf bag.

* * * * *